US008016113B2

(12) United States Patent
Perkins

(10) Patent No.: US 8,016,113 B2
(45) Date of Patent: Sep. 13, 2011

(54) STORAGE SYSTEM WITH IMPROVED POLE SECUREMENT SYSTEM

(75) Inventor: David W. Perkins, Hiawatha, IA (US)

(73) Assignee: Plastic Systems, Inc., Des Moines, IA (US)

( * ) Notice: Subject to any disclaimer, the term of this patent is extended or adjusted under 35 U.S.C. 154(b) by 188 days.

(21) Appl. No.: 12/283,758

(22) Filed: Sep. 16, 2008

(65) Prior Publication Data

US 2010/0065466 A1 Mar. 18, 2010

(51) Int. Cl.

| | |
|---|---|
| ***B65D 19/40*** | (2006.01) |
| ***B65D 19/06*** | (2006.01) |
| ***B65D 25/24*** | (2006.01) |
| *B65D 19/04* | (2006.01) |
| *B65D 19/18* | (2006.01) |

(52) U.S. Cl. ..... 206/600; 220/1.6; 220/9.4; 220/475; 248/519

(58) Field of Classification Search ..... 206/600, 206/386; 220/9.4, 475, 1.6; 248/111, 314, 248/519, 528, 529, 520; *B65D 19/24*
See application file for complete search history.

(56) References Cited

U.S. PATENT DOCUMENTS

| | | | | |
|---|---|---|---|---|
| 186,459 | A | 1/1877 | Buckingham | |
| 371,159 | A | 10/1887 | Wright, Jr. | |
| 648,385 | A | 5/1900 | Burns | |
| 942,733 | A | 12/1909 | Moses | |
| 1,161,336 | A | 11/1915 | Potucek | |
| 1,507,977 | A | 9/1924 | Schaefer | |
| 1,585,390 | A | 5/1926 | Kondolf | |
| 2,147,563 | A | 2/1939 | Turner | |
| 2,345,000 | A | 3/1944 | Newsom | |
| 2,522,597 | A | 9/1950 | Blandford | |
| 2,565,053 | A | 8/1951 | Stenger | |
| 2,617,579 | A | 11/1952 | Buttery | |
| 2,799,440 | A | 7/1957 | Frederich | |
| 2,887,264 | A | 5/1959 | Fallert | |
| 3,045,387 | A | 7/1962 | Simpson | |
| 3,094,361 | A | 6/1963 | Poyer | |
| 3,302,909 | A * | 2/1967 | Glassman | 47/40.5 |
| 3,372,725 | A | 3/1968 | Voorhees | |
| 3,410,328 | A | 11/1968 | Sasai | |
| 3,521,764 | A | 7/1970 | Loomis | |
| 3,701,466 | A | 10/1972 | Woodrow et al. | |
| 3,762,343 | A | 10/1973 | Thacker | |
| 3,949,874 | A | 4/1976 | Heavner | |
| 4,014,496 | A | 3/1977 | Christensson | |
| 4,036,361 | A | 7/1977 | Jacobson | |
| 4,082,215 | A | 4/1978 | Eichenauer | |
| 4,159,096 | A * | 6/1979 | Chase | 248/523 |

(Continued)

OTHER PUBLICATIONS

US 6,675,964, 01/2004, Beck (withdrawn)

*Primary Examiner* — J. Gregory Pickett
*Assistant Examiner* — Ned A Walker
(74) *Attorney, Agent, or Firm* — Brett Trout

(57) ABSTRACT

A stackable, collapsible container for flowable materials. The container utilizes an outer container and a flexible inner liner retained by a base, a top and a plurality of support poles. The support poles are retained in a plurality of holes in the base provided with a plurality of wedges to secure the holes against lateral movement. Providing wedges within tapered holes facilitates the compression molding of the depth of holes required for adequately supporting the support poles.

4 Claims, 8 Drawing Sheets

U.S. PATENT DOCUMENTS 4,216,897 A 8/1980 Collura et al.
4,266,670 A 5/1981 Mykleby
4,339,047 A 7/1982 Johansson
4,359,182 A 11/1982 Perkins
4,383,609 A 5/1983 Lochmiller
4,392,606 A 7/1983 Fremion
4,421,253 A 12/1983 Croley
4,571,881 A * 2/1986 Lathim ..... 47/40.5
4,606,461 A 8/1986 Bolton, Sr.
4,678,089 A * 7/1987 Lang ..... 211/133.4
4,691,859 A 9/1987 Snyder
4,729,505 A 3/1988 Remaks et al.
4,804,087 A 2/1989 Smith
4,880,141 A 11/1989 Gossler
RE33,128 E 12/1989 Nordstrom
4,949,898 A 8/1990 Nederveld
4,976,411 A * 12/1990 Gordon et al. ..... 248/524
5,025,925 A 6/1991 Wiklund
5,215,248 A 6/1993 Moser
5,269,455 A 12/1993 Grigsby
5,402,906 A 4/1995 Brown et al.
5,497,972 A * 3/1996 Sofy ..... 248/523
5,501,395 A 3/1996 McElroy
5,549,341 A 8/1996 Chase et al.
5,722,552 A 3/1998 Olson
5,746,343 A 5/1998 Waltke
5,749,489 A 5/1998 Benner
5,758,856 A * 6/1998 Carnahan et al. ..... 248/523
5,803,346 A 9/1998 Baker et al.
5,897,211 A 4/1999 Hafer et al.
5,934,474 A 8/1999 Renninger et al.
5,943,836 A * 8/1999 Kassardjian ..... 52/301
5,944,252 A 8/1999 Connelly et al.
6,000,549 A 12/1999 Perkins
6,029,884 A 2/2000 Roeland
6,050,410 A 4/2000 Quirion
6,074,331 A 6/2000 Ruggiere, Sr.
6,094,859 A * 8/2000 Kalman et al. ..... 47/40.5
6,113,270 A 9/2000 Hafer
6,164,453 A 12/2000 Perkins
6,170,689 B1 1/2001 Flesher
6,257,539 B1 * 7/2001 Pelaez ..... 248/314
6,286,804 B1 * 9/2001 Avinger et al. ..... 248/523
6,516,965 B1 2/2003 Perkins
6,592,094 B1 * 7/2003 Kao ..... 248/529
7,044,427 B2 * 5/2006 Eckenswiller ..... 248/523
7,055,807 B2 * 6/2006 Pesta ..... 256/65.14
7,111,815 B2 * 9/2006 Mettler et al. ..... 248/519
2003/0132275 A1 7/2003 Ingalls
2005/0127264 A1 * 6/2005 Mettler et al. ..... 248/519
2008/0135438 A1 * 6/2008 Perkins ..... 206/504
2008/0135547 A1 * 6/2008 Perkins ..... 220/4.28
2008/0137997 A1 * 6/2008 Perkins ..... 383/119

* cited by examiner

STORAGE SYSTEM WITH IMPROVED POLE SECUREMENT SYSTEM

BACKGROUND OF THE INVENTION

1. Field of the Invention

The present invention relates to bulk containers for flowable materials and, more specifically, to a flexible bulk container system which is stackable both in use and in storage, and is collapsible to facilitate more compact storage and transportation.

2. Description of the Prior Art

It is known in the art to provide rigid containers, such as drums, for the storage and transportation of flowable or fluid materials. Such prior art drums, however, are bulky and heavy, even when not in use. Also, by utilizing the strength attributes of a circular exterior, such drums do not maximize space most efficiently. Accordingly, when such drums are placed on a pallet, there are substantial open interior spaces, which could be better utilized to store flowable materials.

It is also known in the art to reduce weight by providing a container of a flexible, circular construction, which may be collapsed for transportation and storage after use. While such containers utilize space somewhat more efficiently than drums, are somewhat lighter than drums, and may be reduced in size for storage, such containers do not maximize the available space for storage of flowable materials. Additionally, since such containers do not possess rigid sides, they cannot be stacked, thereby substantially reducing their ability to maximize utilization of warehouse space.

While it is known in the art to provide rigid, square containers, maximizing the space allocation and allowing for the containers to be stacked, such containers are typically heavy, expensive, and difficult to collapse for storage or transportation when not in use.

It is also known in the art to provide collapsible containers with rigid side supports to allow for the containers to be stacked. One drawback associated with this construction is that such containers typically require strapping material or other securement mechanisms to be provided across the top of the container, thereby reducing access to the top of the container and preventing the container from being used in association with many flowable material filling systems. Also, such containers are typically of a cylindrical construction, thereby preventing them from utilizing space most efficiently.

Collapsible rectangular containers are also known in the art. Such containers typically use poles either rigidly secured to one another, or secured to one another via cables or other connection systems. Rigid connection systems are useful in maintaining lateral support of adjacent poles. However, such rigid connection systems are more difficult to collapse, heavier and difficult to set up and take down. Systems utilizing cables or the like to connect adjacent poles are also sufficient in transferring force between adjacent poles, but are complicated to set up and take down, and may snag or otherwise damage the container containing the flowable material.

Accordingly, it is desirable to provide a container for flowable materials which is of a low-cost, lightweight construction, easily collapsible for storage and transportation when not in use, stackable, and which provides a large access area into the container from the top of the container. It would also be desirable to provide a system which has eliminated the requirement for permanent or complex connection systems between adjacent poles. The difficulties encountered in the prior art heretofore are substantially eliminated by the present invention.

SUMMARY OF THE INVENTION

In an advantage provided by this invention, a stackable, collapsible container is provided which is of a low-cost manufacture.

In an advantage provided by this invention, a stackable, collapsible container is provided which allows for easy, low-cost maintenance.

Advantageously, this invention provides a stackable, collapsible container which is of a lightweight construction.

Advantageously, this invention provides a stackable, collapsible container which is capable of being stacked upon a similar container when filled.

Advantageously, this invention provides a stackable, collapsible container which efficiently utilizes available warehouse space.

Advantageously, this invention provides a stackable, collapsible container which eliminates permanent connections between adjacent support bars.

Advantageously, this invention provides a stackable, collapsible container which eliminates cable connections between adjacent support bars.

The present invention relates to a stackable, collapsible container having a flexible outer skin and a rigid support. The rigid support includes a plurality of support bars provided in holes in a base and a top. The holes provided in the base are provided with a plurality of ridges, which support the bars while facilitating the compression molding process associated with constructing the base.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
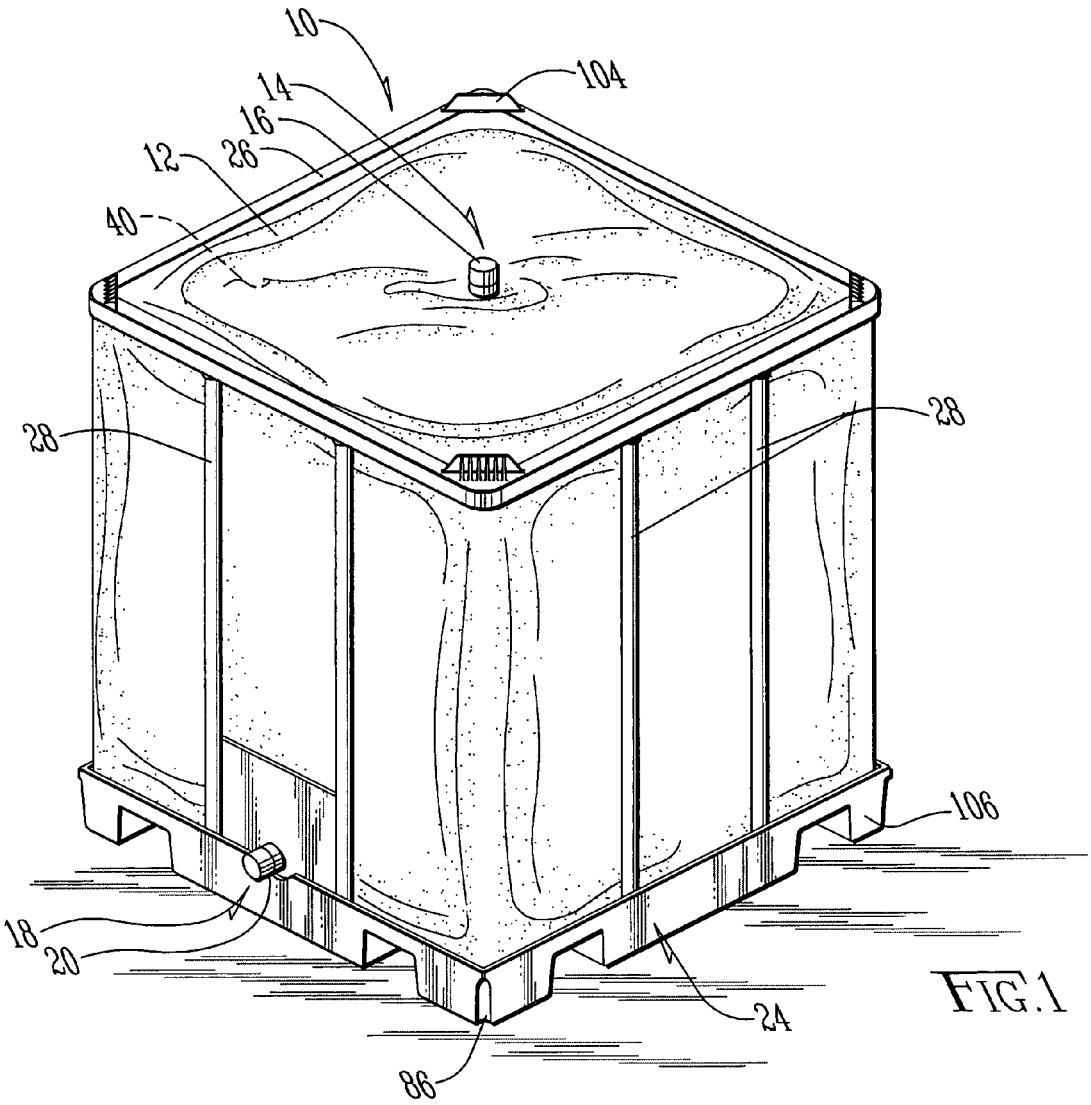
FIG. 1 illustrates a top perspective view of a stackable, collapsible container of the present invention.

The stackable, collapsible container of the present invention is shown generally as (10) in FIG. 1. The container (10) includes a removal, flexible inner liner (12) having an inlet opening (14) with a top cap (16) and a drain or outlet opening (18) with a threaded plug (20) therein. The inner liner (12) is constructed of polyethylene, such as that well known in the art to hold non-hazardous fluid material. The container (10)

includes an outer skin (22). In the preferred embodiment, the outer skin (22) is constructed of a polypropylene fabric-like material. The outer skin (22) can be constructed of any lightweight material known in the art having strength characteristics sufficient to contain a flowable material. It is preferable that the outer skin (22) be waterproof or coated with a waterproof material in a manner such as that known in the art to allow the container (10) to be used outdoors as well as indoors. The outer skin (22) does not include the top of the container (10) to allow access to the inlet opening (14) through the top cap (16).

As shown in FIG. 1, the container (10) includes a pallet type base (24) and a top (26) coupled together by a plurality of support poles (28). While the base (24) and top (26) may be constructed of any suitable material, in the preferred embodiment the base (24) and top (26) are compression molded of a forty percent fiberglass filled polypropylene homopolymer to withstand the significant loads placed upon the base (24) and top (26) during transport of flowable materials.

Figure 2:
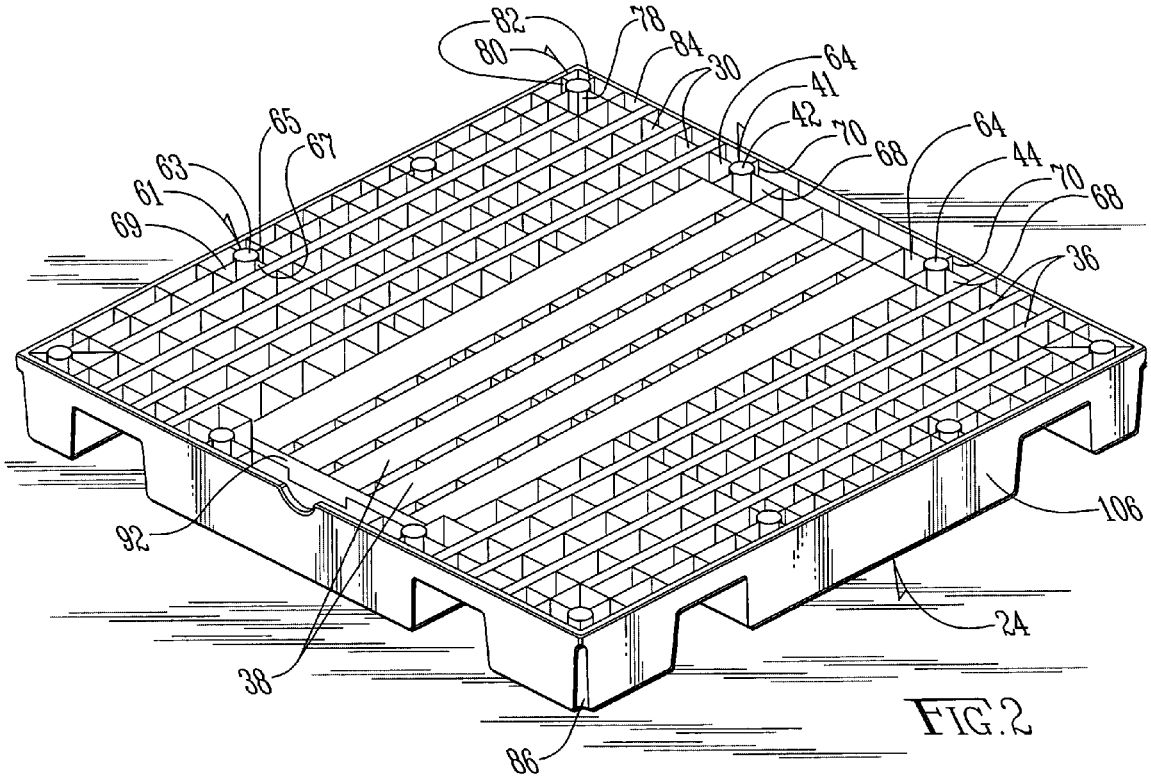
FIG. 2 illustrates a top perspective view of the base of the stackable, collapsible container of FIG. 1.
Figure 3:
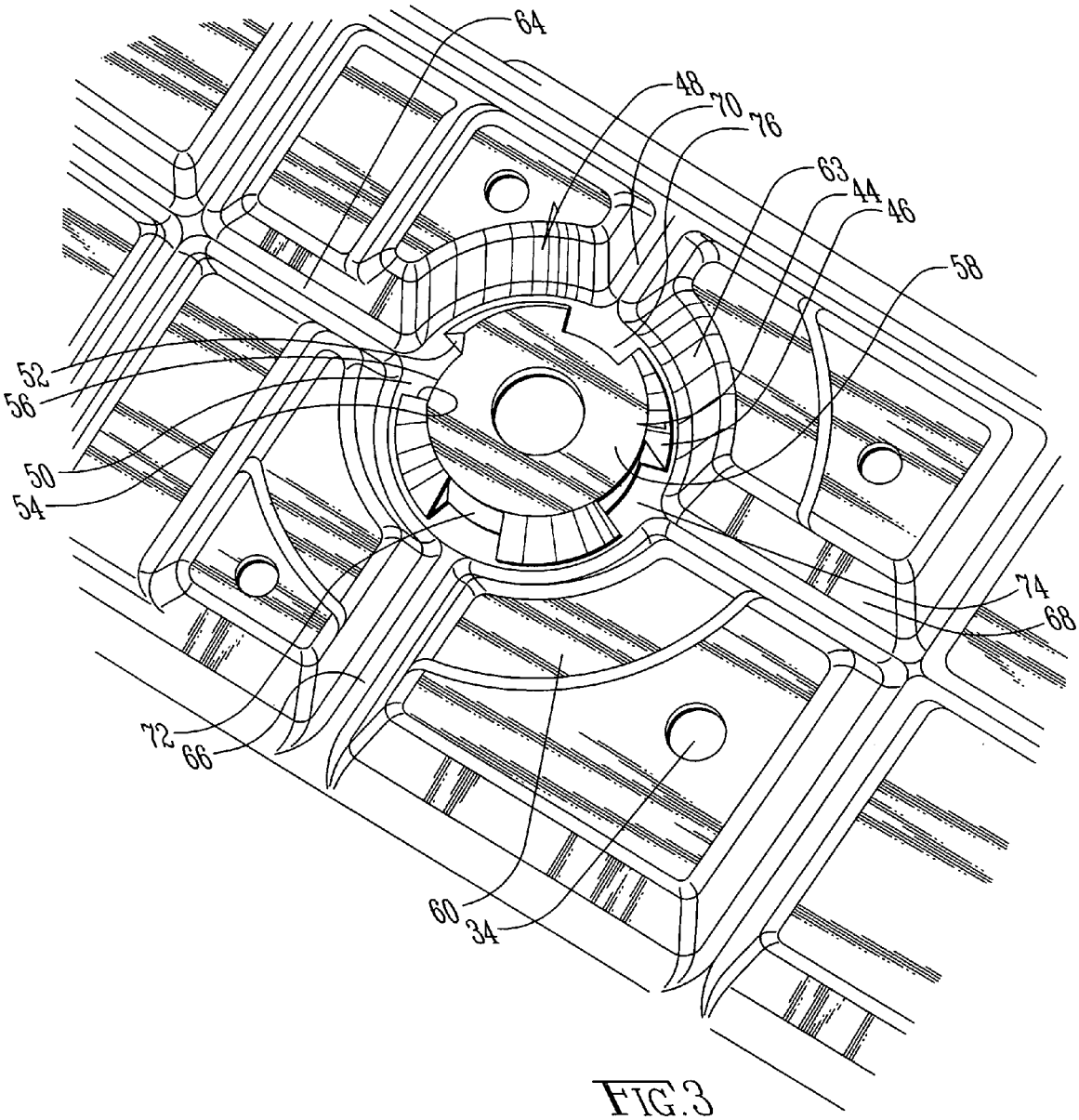
FIG. 3 illustrates a top perspective view of the hole for the retention of the support bar in the base of the stackable, collapsible container of the present invention.

As shown in FIG. 2, the base (24) is provided with a plurality of ribs (30) to create a plurality of tiny compartments (32). Preferably, each compartment is provided with a drain hole (34) to allow for adequate drainage to prevent the growth of mildew and retention of water. The base is also molded with a plurality of flats (36) with downward sloping ramps (38) to facilitate emptying of a flowable material (40) through the outlet (18). (FIGS. 1 and 2). As shown in FIG. 2, the base (24) is provided around a plurality of receivers (41) defining cavities, such as a plurality of holes (42) to support the support poles (28). Preferably, the depth of the holes is at least twice as long as the width or diameter of the holes (42). As shown in FIG. 3, the side hole (44), or receiver, includes a main wall (46) defining a cavity (48). Integrally molded into the main wall (46) is a first wedge (50). The main wall (46) is between three and thirty millimeters thick. The first wedge (50) includes a first sidewall (52), second sidewall (54) and a face (56). The first sidewall (52) and second sidewall (54) are wider near the top of the hole (44) than near the base (58), causing the wedge (50) to taper from the top (62) of the hole (44) to the base (58) of the hole (44).

Figure 4:
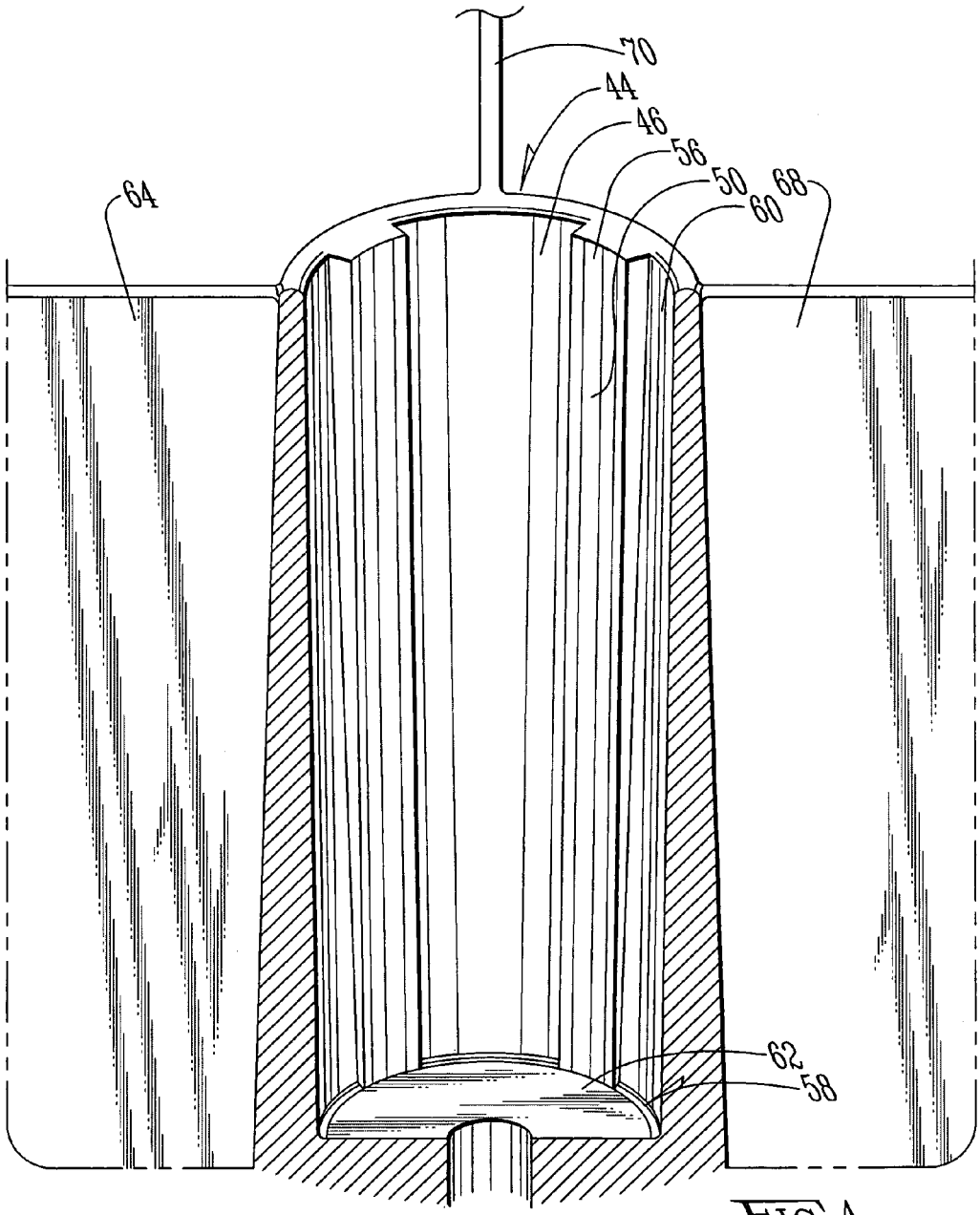
FIG. 4 illustrates a side elevation in cross-section of the hole for support bar retention of the base of the stackable, collapsible container of the present invention.

As shown in FIG. 4, the main wall (46) is wider near the top (60) than the base (58). This taper facilitates the extraction of the compression mold during the manufacturing process. Given the depth of the hole (44) which, in the preferred embodiment, is between five and twenty centimeters, more preferably between ten and fifteen centimeters, and most preferably approximately fourteen centimeters, compression molding of such cavities is difficult if the cavities have non tapering walls. While shallower holes are easier to compression mold, they do not provide the support necessary for the support poles (28). While it is possible to compression mold a tapered wall all the way around the cavity (44), the tapered wall would not support the support poles (28) near the top (60) of the hole (44) and, therefore, would not adequately support the support poles (28).

Accordingly, applicant has provided the cavity with the plurality of wedges (50) with faces (56) which contact the support poles (28) from the top (60) to the base (58) of the cavity (48). The support pole (28) is in contact with the face (56) of the wedge (50) but is not in contact with the first sidewall (52) or second sidewall (54) of the wedge (50). While in the preferred embodiment the cavity is shown with four wedges (50) in each hole (44), the hole (44) may be provided with one to five, six or any desired number of wedges (50). In the preferred embodiment the exposed surface area of the main wall (46) is greater than the exposed surface area of the faces (56) of the wedges (50) to facilitate compression molding of the base (24). Additionally, while the base (24) is molded to provide a substantially straight face (56) for contact with the support poles (28), the faces (56) may be curved and may be constructed of any dimensions plus or minus ten degrees from vertical, using any desired type of molding process. Additionally, while the wedges (50) are shown to be of an interrupted construction from the top (60) to the base (58) of the hole (44), the wedges (50) may be constructed with a plurality of breaks which may be horizontal, vertical or any type of diagonal break. Additionally, the wedges (50) may be positioned just near the top (60) of the hole (44), the base (58) of the hole (44), or may be staggered across the main wall (46) as desired. The hole (44) is preferably twice as deep as the diameter and the wedges (50) are at least twice as thick near the top as the bottom. Additional receivers (61) defining additional holes (63) are constructed in a similar manner with four main walls (65), each having sidewalls (67) and (69).

As shown in FIG. 4, immediately after the base (24) has been removed from the compression mold, a stainless steel washer (62) having an outer diameter of approximately 3.4 centimeters is dropped into the hole (44) to contact the base (58). As the base (24) cools and shrinks, the washer (62) is permanently secured to the base (58) of the hole (44).

As shown in FIG. 3, secured to the exterior surface (63) of the main wall (46) are a plurality of ribs (64), (66), (68) and (70), which act as buttresses for the wedges (50), (72), (74) and (76) transporting lateral force from the support poles (28) through the wedges (50), (72), (74) and (76), through the main wall (46) to the ribs (64), (66), (68) and (70), and into the remainder of the base (24). As shown in FIG. 2, as the corner holes (78) do not provide for a standard buttress on the corner piece, the corner holes (78) are provided with a wedge buttress (80) which dissipates the forces on the wedge (82) to the sides (84) and (86) of the base (24). While a single rib can be used, the tendency is for a single rib to put such a great amount of pressure on such a small area so as to rupture the sides (84) or (86) of the base (24). The wedge (80), however, dissipates the force over a greater area, thereby reducing the likelihood of rupture.

As shown in FIG. 1, as compression molding such a thick supportive wedge (80) at the corner near a hole (82) would likely lead to a failure during the compression molding process, the corner is provided with a cutout (88) which still allows the wedge (80) to dissipate forces to the sides (84) and (86) of the base (24), while reducing the thickness of the wedge (80) for the compression molding process to allow the mold to be extracted from the base without destruction of the wedge (80).

Figure 5:
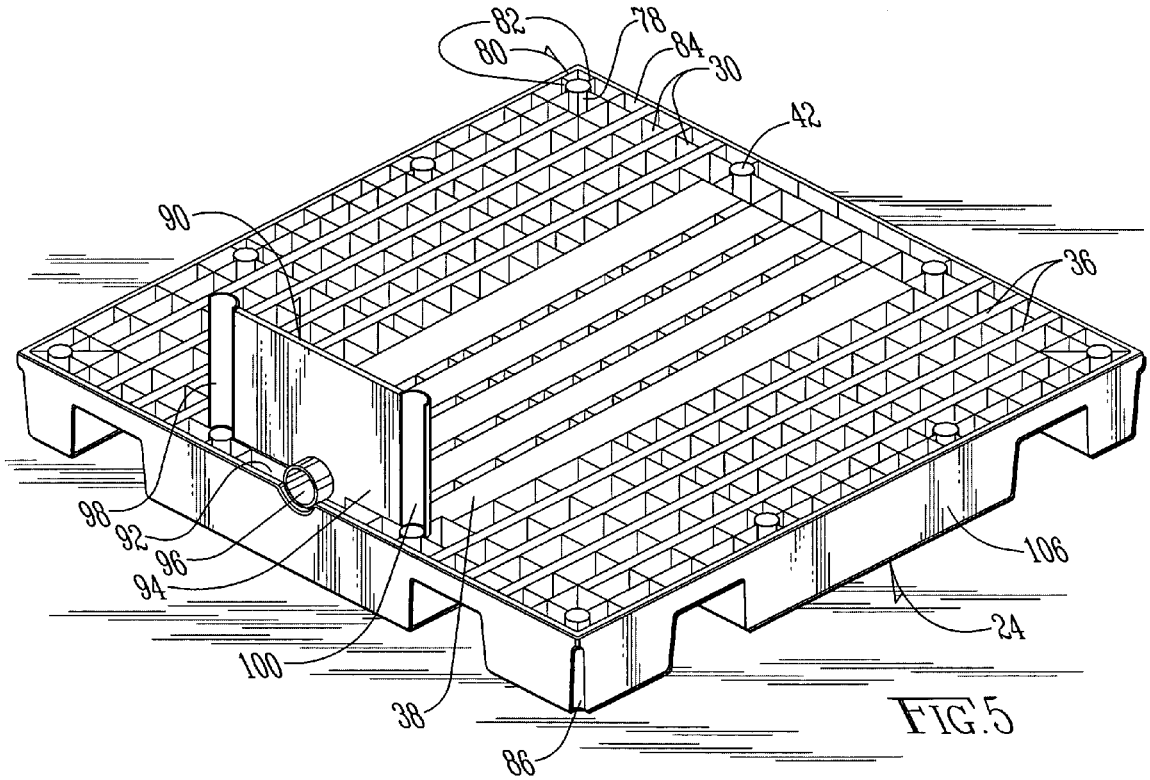
FIG. 5 illustrates a top perspective view of the retention plate of the present invention secured in the base.

When it is desired to utilize the stackable, collapsible container (10) of the present invention, a retention plate (90) compression molding of a glass filled material is secured in the slot (92) molded into the base (24) shown in FIGS. 2 and 5. The base (24) is provided with a support wall (94) to add stability to the retention plate (90). The retention plate (90) is preferably provided with an opening (96) to accommodate the outlet opening (18) of the flexible liner (12). (FIGS. 1, 2 and 5). The retention plate is also provided with a pair of curved retainers (98) and (100) offset to the rear of the retention plate (90).

As shown in FIG. 1, once the retention plate (90) has been set in place, the support poles (28) can be secured into the holes (42) of the base (24). As shown in FIGS. 1 and 5, the support poles (28) engage the curved retainers (98) and (100) of the retention plate (90), preventing the retention plate (90) from being pushed outward past the support poles (28) by the force of the flowable material (40). The outer skin (22) is thereafter provided around the exterior of the corner support poles (28) and through the interior of the side support poles (28). Thereafter, the flexible liner (12) is provided on the interior of the stackable, collapsible container (10) and the outlet opening (18) provided through the opening (96) in the retention plate (90) and the threaded plug (20) secured thereto. Thereafter, the top (26) is provided over the support poles (28). The under side of the top (26) is provided with cavities to retain the support poles (28). As the cavities of the top (26) are much shallower than the holes (42) of the base (24), the cavities may be constructed with a one and one-half degree taper. Alternatively, if desired, the cavities may be constructed with wedges in a manner similar to that described above in association with the holes (42).

Figure 6:
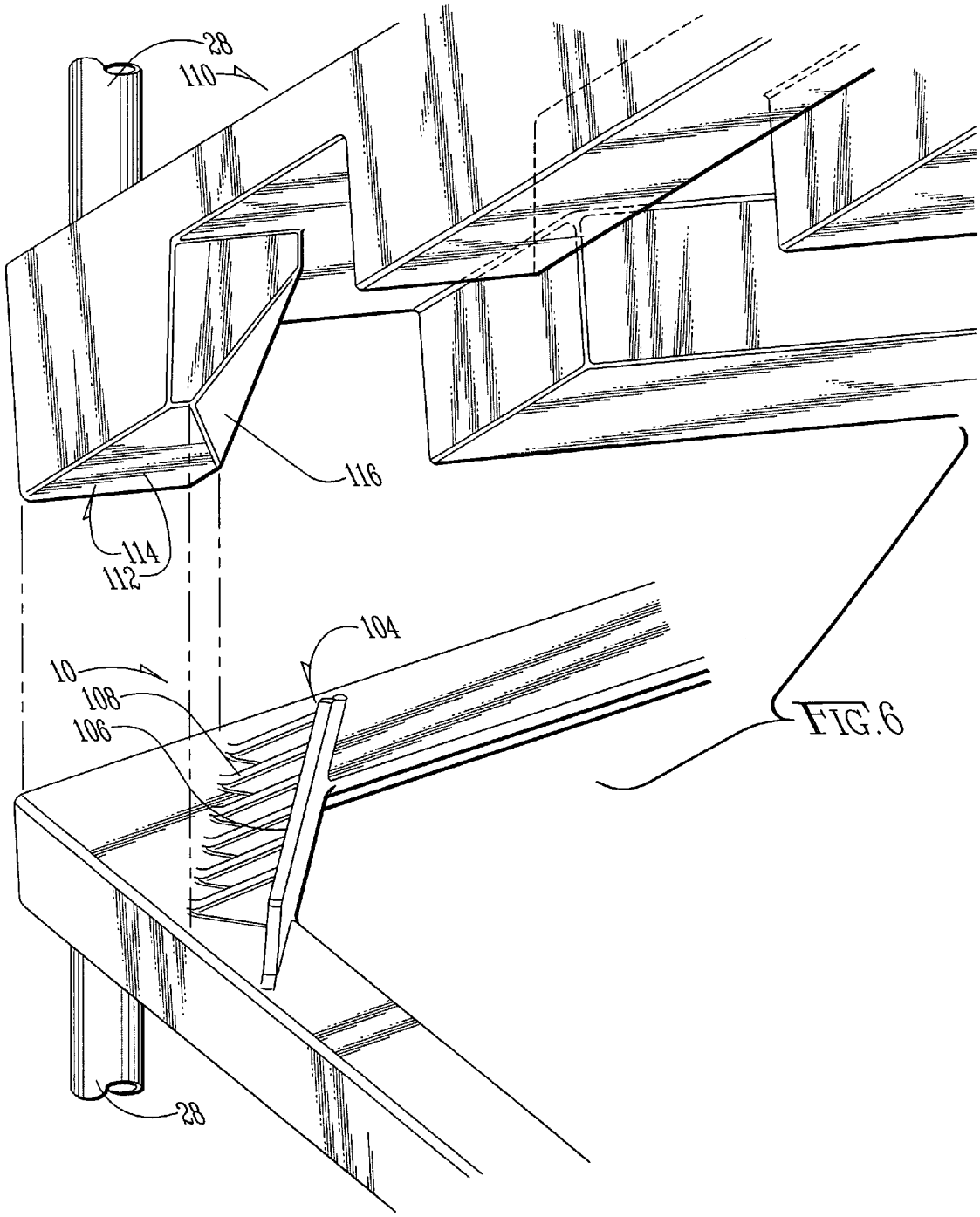
FIG. 6 illustrates a side perspective view of the base of one container matingly aligned with the top of another container.
Figure 7:
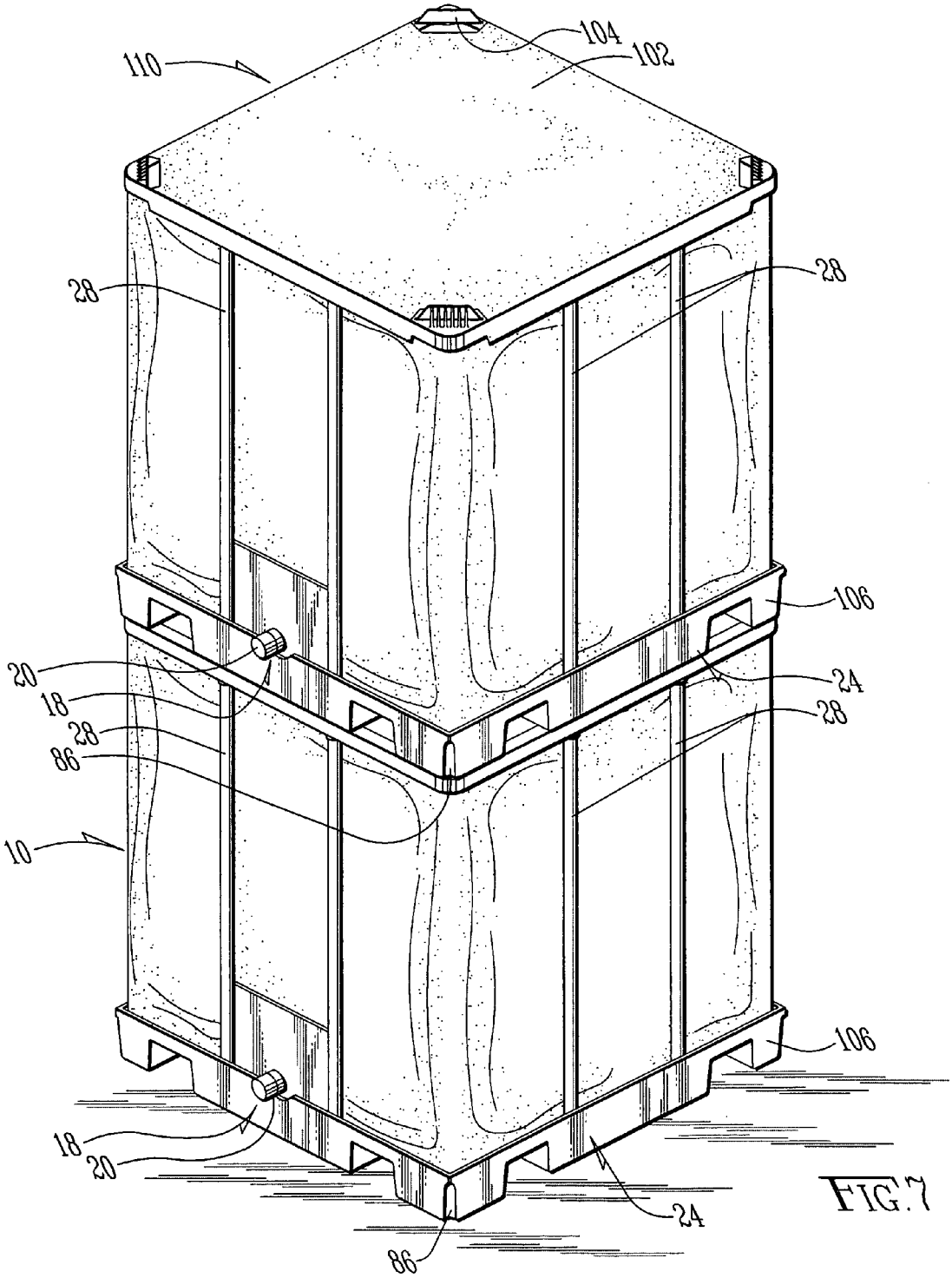
FIG. 7 illustrates a top perspective view of the stackable, collapsible container of the present invention, stacked upon a second stackable, collapsible container of a similar construction.

Once the top (26) has been coupled to the support poles (28), the top cap (16) is removed and the flowable material (40) is provided into the flexible liner through the inlet opening (14). Once the flexible liner (12) has been filled, the top cap (16) is reattached and, if desired, a flexible cover (102) constructed of any desired material, which may be flexible, solid or semi-flexible, is provided over the top (26) to protect the top cap (16) inlet opening (14) and flexible liner (12) from dust and damage. If desired, as shown in FIG. 1, the top (26) may be provided with locator pins (104). Each locator pin (104) is provided with a front face (106) which extends above the top (26) of the container (10). The front face (106) is supported by a plurality of ribs (108), but may be supported by a solid block of material tapering downward from the front face (106) to the top (26) of the container (10). (FIG. 6). In addition to strengthening the top (26), the locator pins (104) also assist in locating containers (10) and (110) relative to one another when one container (110) is stacked on top of another container (10). (FIG. 7). As shown in FIG. 6, the bottom (112) of the feet (114) of the container (10) are provided with chamfered faces (116) sufficient to fit into mating engagement with the ribs (108) of the locator pins (104). When it is desired to stack the container (110) on top of the other container (10), even if the containers (110) and (10) are not perfectly aligned, as the container (110) is moved into position above the container (10), the ribs (108) of the locator pins (104) engage the chamfered faces (116) of the feet (114), guiding the container (110) into precise mating engagement with the locator pins (104) of the container (10).

Figure 8:
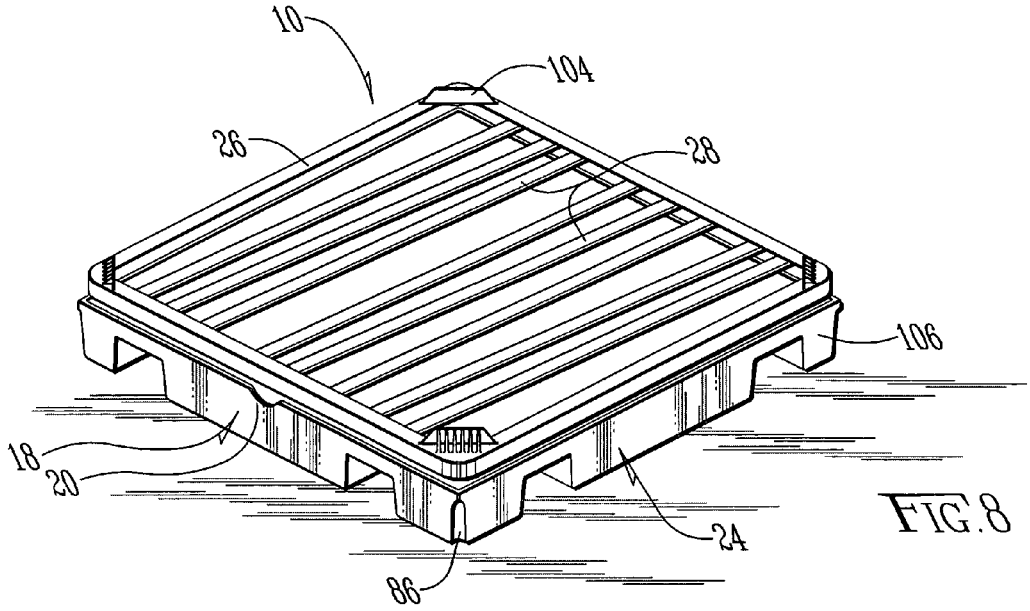
FIG. 8 illustrates a top perspective view of the stackable, collapsible container of the present invention collapsed for storage and transport.

As shown in FIG. 8, when it is desired to transport the stackable, collapsible container (10) in a collapsed orientation, the flowable material (40) is removed from the flexible liner (12), the top (26) is removed from the support poles (28), and the support poles (28) and retention plate (90) are removed from the base (24). Thereafter, the support poles (28) and retention plate (90) may be placed on top of the base (24) and the top (26) provided directly on top of the base (24). The bottom of the top (26) and top of the base (24) are preferably provided with small retainers to allow the top (26) and base (24) to fit into mating engagement. As the top (26) is provided with retainers (104) and the base (24) is provided with mating recesses (106), the stackable, collapsible container (10) may be stacked in the collapsed form shown in FIG. 6 as well.

The foregoing description and drawings merely explain and illustrate the invention, and the invention is not limited thereto, except insofar as the claims are so limited, as those skilled in the art that have the disclosure before them will be able to make modifications and variations therein without departing from the scope of the invention. By way of example, the stackable, collapsible container (10) of the present invention may be constructed of any desired dimensions and of any suitable material. Additionally, any desired number of support poles (28) may be utilized and the base (24) and top (26) may be constructed of any suitable configuration.

What is claimed is:

1. A stackable collapsible container comprising:

(a) a pallet base having a cylindrical receiving cavity comprising:

(i) a base;

(ii) a rim;

(iii) a circumferential wall extending longitudinally between said base and said rim, said circumferential wall defining a cavity depth and a cavity diameter, wherein said cavity depth is at least twice as long as said cavity diameter, said circumferential wall comprising at least one rib having a first sidewall being wider near said rim than near said base and a second sidewall being wider near said rim than near said base;

(b) a pole provided within said receiving cavity, wherein said pole is in contact with said circumferential wall, wherein said pole is not in contact with said first sidewall and wherein said pole is not in contact with said second sidewall.

2. The stackable collapsible container of claim 1, wherein said circumferential wall further comprises a main wall that is between three millimeters and thirty millimeters thick.

3. The stackable collapsible container of claim 1, wherein said at least one rib is a first rib and a second rib, said first rib comprising said first sidewall and said second sidewall, and said second rib comprising a third sidewall being wider near said rim than near said base and a fourth sidewall being wider near rim than near said base.

4. The stackable collapsible container of claim 1, further comprising a secondary cylindrical receiving cavity provided in said pallet base, said secondary cylindrical receiving cavity comprising:

(a) a secondary base;

(b) a secondary rim;

(c) a secondary circumferential wall extending longitudinally between said secondary base and said secondary rim, said secondary circumferential wall defining a secondary cavity depth and a secondary cavity diameter, wherein said secondary cavity depth is at least twice as long as said secondary cavity diameter, said secondary circumferential wall comprising at least one secondary rib having a third sidewall being wider near said secondary rim than near said secondary base and a fourth sidewall being wider near said secondary rim than near secondary said base.

* * * * *